US005540301A

United States Patent [19]

Dumont

[11] Patent Number: 5,540,301

[45] Date of Patent: Jul. 30, 1996

[54] AUTOMATED BULK SELF-CHECKOUT STATION APPARATUS

[76] Inventor: Charles Dumont, 8925 Collins Ave., Surfside, Fla. 33154

[21] Appl. No.: 328,683

[22] Filed: Oct. 25, 1994

Related U.S. Application Data

[63] Continuation-in-part of Ser. No. 241,354, May 11, 1994, Pat. No. 5,437,346.

[51] Int. Cl.[6] ..... A47F 9/04

[52] U.S. Cl. ..... 186/61; 186/62; 235/383

[58] Field of Search ..... 186/52, 56, 61, 186/62; 235/383

[56] References Cited

U.S. PATENT DOCUMENTS

| | | | |
|---|---|---|---|
| 3,538,311 | 11/1970 | Weidmann | 235/383 |
| 3,836,755 | 9/1974 | Ehrat | 235/383 |
| 4,071,740 | 1/1978 | Gogulski | 235/431 |
| 4,572,347 | 2/1986 | Eisermann | 186/62 X |
| 4,676,343 | 6/1987 | Humble et al. | 186/61 |
| 4,792,018 | 12/1988 | Humble et al. | 186/61 |
| 4,929,819 | 5/1990 | Collins, Jr. | 235/383 |
| 4,964,053 | 10/1990 | Humble | 364/466 |
| 5,195,613 | 3/1993 | Kohno | 186/59 |
| 5,239,167 | 8/1993 | Kipp | 235/383 |
| 5,252,814 | 10/1993 | Tooley | 235/383 |
| 5,343,025 | 8/1994 | Usui | 235/383 |
| 5,362,949 | 11/1994 | Gulick | 235/385 |
| 5,426,423 | 6/1995 | Raimbault et al. | 235/383 X |

FOREIGN PATENT DOCUMENTS

| | | | |
|---|---|---|---|
| 2125869 | 12/1972 | Germany | 186/61 |
| 3114139A1 | 4/1982 | Germany | G06K 7/01 |
| 3114139 | 11/1982 | Germany . | |
| 3-80384 | 4/1991 | Japan | 235/383 |
| 2161631 | 1/1986 | United Kingdom | G07C 11/00 |

*Primary Examiner*—F. J. Bartuska
*Attorney, Agent, or Firm*—Oltman and Flynn

[57] ABSTRACT

An automatic bulk self-checkout apparatus includes several purchase items, each item being marked with a bar code containing item price information, a purchase item holder for retaining purchase items as they are gathered and transported to a checkout area of a store, a bar code scanner assembly for reading the bar codes while the items are inside the item holder and for sending information contained in the bar codes as signals, a bar code processing assembly for receiving and converting the signals into numerical price data and for totalling prices of the items within the item holder. The apparatus preferably includes a tunnel structure having an entry port, an exit port, a top wall and two opposing side walls and a floor, and sized to receive through the ports the item holder, where the scanner assembly is located within the tunnel structure and oriented to scan the bar codes on the items within the item holder. The apparatus also preferably includes a conveyor belt for automatically transporting the item holder through the tunnel structure from the entry port to the exit port. The apparatus may additionally include a first sensor assembly for sensing an item holder placed at the entry port and activating the conveyor belt for a prescribed time duration. A method of checking out purchase items includes the steps of placing the items into the purchase item holder, reading the bar codes with the scanner assembly while the items remain in the holder, and totaling prices indicated in the bar codes.

14 Claims, 3 Drawing Sheets

AUTOMATED BULK SELF-CHECKOUT STATION APPARATUS

FILING HISTORY

This application is a continuation-in-part of application Ser. No. 08/241,354 filed on May 11, 1994, now U.S. Pat. No. 5,437,346.

BACKGROUND OF THE INVENTION

1. Field of the Invention

The present invention relates generally to the field of devices for registering and totalling prices of purchased items. More specifically, it relates to an automated checkout apparatus for rapid and virtually simultaneous reading of bar codes on and totalling of prices for items selected for purchase. Each purchase item is marked in advance with a bar code identifying the nature of the product, its weight and its price.

The inventive checkout apparatus preferably includes a shopping cart receiving tunnel having an entry port, side and top walls and an exit port. The tunnel has a floor covered by a conveyor belt, activated by a cart sensor located at the tunnel entry port. The conveyor belt supports and carries the shopping cart from the entry port to a scanning location, and then through the exit port. The conveyor belt stops at the scanning location, and a scanner assembly inside the tunnel reads the bar codes of the items in the shopping cart without the need of removing the items from the cart. A scale in the tunnel floor weighs the cart and its contents. A computer connected to the scanner assembly automatically compares the scale weight with the calculated totalled weight for the items and if there is a match, it totals the prices and prints a receipt. The tunnel preferably has a motorized entry door and a motorized exit door which both automatically close when the shopping cart is conveyed inside the tunnel, for safety and security purposes. These doors remain closed until money, a credit card, coupons, or other payment means are inserted into a payment receiving assembly attached adjacent the entry port, and the totalled price is thereby paid. The payment receiving assembly sends a signal to the computer which in turn causes the entry and exit doors to open. The conveyor belt is then activated by the computer to carry the cart through the exit port and to a bagging area where the customer or store employee bags the purchased items. An intruder sensor is also preferably provided in the tunnel to detect a human or animal presence, and is connected to the computer which in turn automatically prevents closure of the doors and prevents activation of the conveyor belt and bar code scanner assembly.

2. Description of the Prior Art

There have long been checkout stations in stores where items to be purchased are sorted and their prices totalled. Customers select and gather these items in bags, baskets or carts. Checkout stations have typically included a counter, located near a store exit door, where customers unload items they wish to purchase, and some sort of adding device operated by a store employee. Adding devices for this purpose soon evolved into the cash registers, which required the individual entry of numerical characters and categories of goods, and which included a mechanism for totalling the entered figures. Conveyor belts were developed for carrying items along the counter to a bagging area and the counters were oriented to follow a general line from the center of the store toward the exit door. Eventually bar codes replaced numerical price stickers on purchase items and scanners were built into checkout counters to read the codes of items which had to be presented one by one with the continual assistance of a cashier. The cash register required some additional manual operation to complete the transaction. Despite these advances, the handling of purchase items one by one to register and total their prices remains slow and inefficient, often causing long lines and customer frustration. Furthermore, store profits are diminished by cashier salaries.

One prior checkout system is that of Kohno, U.S. Pat. No. 5,195,613, issued on Mar. 23, 1993. Kohno discloses a commodity data reader including a checkout counter having an upright instrument stand protruding from one longitudinal edge. On the counter side of the stand is a scanner window. The customer places containers filled with purchase items on the counter and leans on the stand for comfort while individually lifting the items out of the containers to scan their bar codes. A problem with Kohno is that the customer must scan each item separately, which can be a long and laborious task. It is in recognition of this situation that the customer is supposed to lean on the stand. "The operator must slouch slightly in scanning bar codes [and thus] is not fatigued after working for a long time . . . " Column 5, lines 22–24. Another problem is that the purchase items are not protected from theft during the checkout operation. A person could snatch a container full of items from the counter and dash for the exit door.

Collins, Jr., U.S. Pat. No. 4,929,819, issued on May 29, 1990, teaches a method and apparatus for self scanning of purchase items in a store. Shopping carts are equipped with a multi-walled receptacle for receiving and transporting items having product codes attached to them. An electric module including a code scanner, a data processor and a video camera is removably attached to each cart. Each item selected for purchase is passed in front of a scanner window on the module and deposited in the cart. Then during checkout the module is detached from the cart and the data downloaded and processed at a checkstand. A problem with Collins is that the customer must pass each item in front of a scanner window to register the price, which becomes a time consuming and tiresome task.

There are three U.S. Patents issued to Humble et al.: U.S. Pat. Nos. 4,792,018, issued on Dec. 20, 1988; 4,964,053, issued on Oct. 16, 1990; and 4,676,343, issued on Jun. 30, 1987. All three of these patents relate to a self-service distribution system. Purchase items are passed over a scanner window in a counter surface, sent through a tunnel on a conveyor belt for security against theft, and separated and bagged by hand as they exit the tunnel. Security gates between checkout stations prevent customers from exiting or gaining access to checked items until the bill is paid. The items are weighed as they enter the tunnel and the weight is compared with weight data in the scanned bar code of the item to confirm that the code tags match the items. The latest Humble et al. patent concerns checking of produce items not having bar codes where icons are selected to enter data. A problem with Humble et al. is that the customer or a cashier must still pass the items individually, one by one, over the scanner window to register the prices. "The customer now passes each item, one by one, UPC code down, over the reader 10 and deposits the item on entry conveyor 12." U.S. Pat. No. 4,792,018, column 4, lines 65–67. The tunnel provides security from theft during checkout, but little else. The security gates blocking the exit of customers may be of questionable legality, and lead to accusations of false imprisonment. Yet without these gates, the system does not fully protect the purchase items.

Kipp, U.S. Pat. No. 5,239,167, issued on Aug. 24, 1993, reveals a system for operator-unassisted checkout of purchase items randomly disposed in a container. A transmitter containing a power source is attached to each item and is activated during checkout to send a signal to a decoder. The signals indicate the prices, and the prices are then totalled while the items remain together in their container. A problem with Kipp is that the providing of an individual transmitter on each purchase item for a single use makes the system expensive to operate. There is also the possibility of interference among several transmitter signals sent at once.

It is thus an object of the present invention to provide an automated checkout station apparatus which eliminates the need to remove purchase items from a shopping cart or other item holder and the need to enter their prices one by one.

It is another object of the present invention to provide such an apparatus which reads prices quickly and virtually simultaneously while the items remain together in the item holder, without the aid of a cashier.

It is still another object of the present invention to provide such an apparatus which is safe for customer use, requires no special skills to operate, and reduces theft of purchase items.

It is finally an object of the present invention to provide such an apparatus which is relatively simple in design, reliable and inexpensive to manufacture and maintain.

SUMMARY OF THE INVENTION

The present invention accomplishes the above-stated objectives, as well as others, as may be determined by a fair reading and interpretation of the entire specification.

An automatic bulk self-checkout apparatus is provided, including several purchase items, each item being marked with a bar code containing item price information, a purchase item holder for retaining purchase items as they are gathered and transported to a checkout area of a store, a bar code scanner assembly for reading the bar codes while the items are inside the item holder and for sending information contained in the bar codes as signals, a bar code processing assembly for receiving and converting the signals into numerical price data and for totalling prices of the items within the item holder. The apparatus preferably includes a tunnel structure having an entry port, an exit port, a top wall and two opposing side walls and a floor, and sized to receive through the ports the item holder, where the scanner assembly is located within the tunnel structure and oriented to scan the bar codes on the items within the item holder. The apparatus also preferably includes a conveyor belt for automatically transporting the item holder through the tunnel structure from the entry port to the exit port. The apparatus may additionally include a first sensor assembly for sensing an item holder placed at the entry port and activating the conveyor belt for a prescribed time duration. The apparatus may additionally include an entry door for opening and closing the entry port and an exit door for opening and closing the exit port. The entry door and exit door are preferably formed of a series of pivotally and longitudinally interconnected slat members, and where motors are provided to open and close the entry and exit doors. The item holder is preferably a shopping cart, and the shopping cart preferably contains item retaining baskets for retaining the items after checkout while the items are transported from the store. The bar code scanner assembly preferably includes one of the following: an ultra-sonic wave generating and sensing assembly, an ultra-violet wave generating and sensing assembly, an X-ray wave generating and sensing assembly, a magnetic field generating and sensing assembly, a micro-wave generating and sensing assembly, or an infrared wave generating and sensing assembly.

A method of checking out purchase items is also provided using the above-described apparatus, including the steps of placing the items into the purchase item holder, reading the bar codes with the scanner assembly while the items remain within the holder, and totaling prices indicated in the bar codes with the processing assembly.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
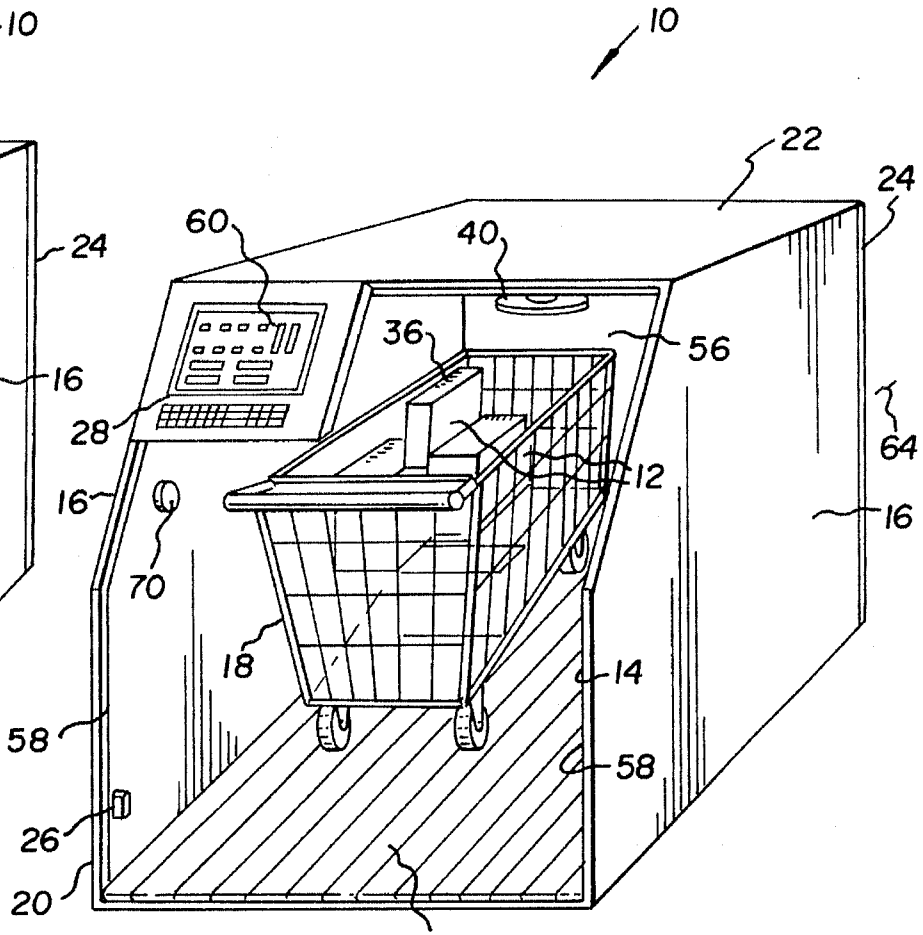
FIG. 2 is a view as in FIG. 1, with a shopping cart containing purchase items inserted into the tunnel.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1:
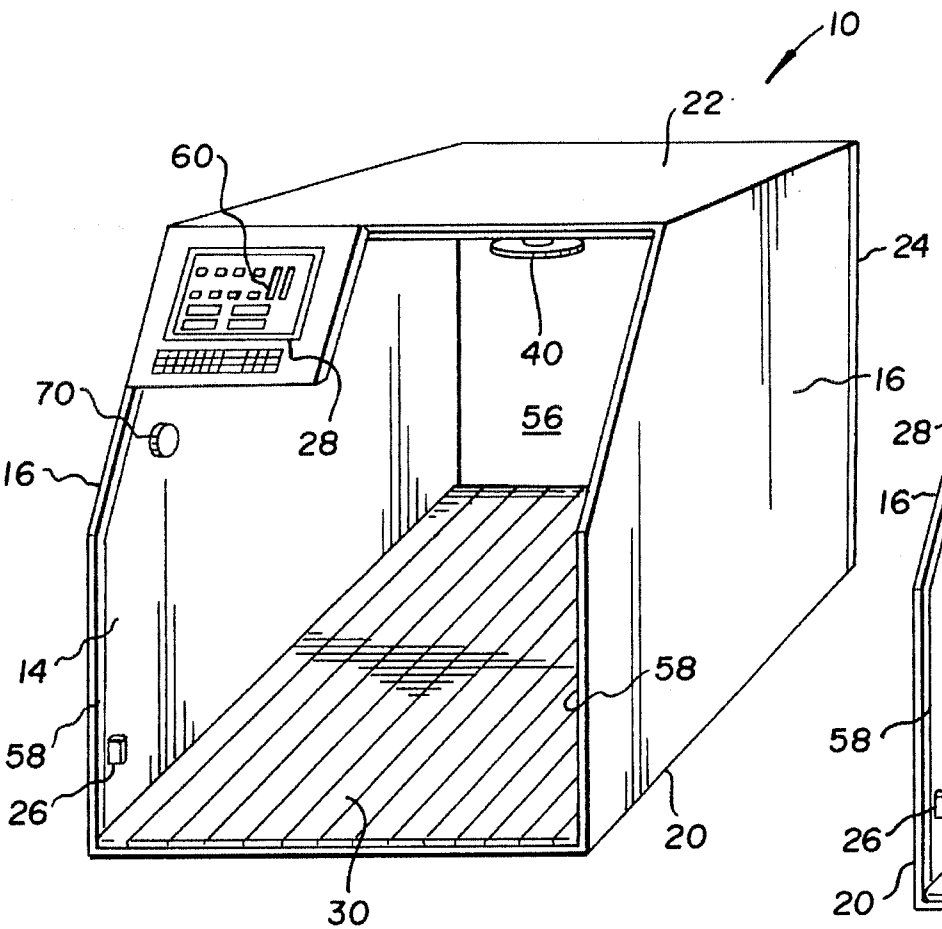
FIG. 1 is a perspective view of the inventive apparatus with the entry door removed to reveal the scanner assembly.
Figure 4:
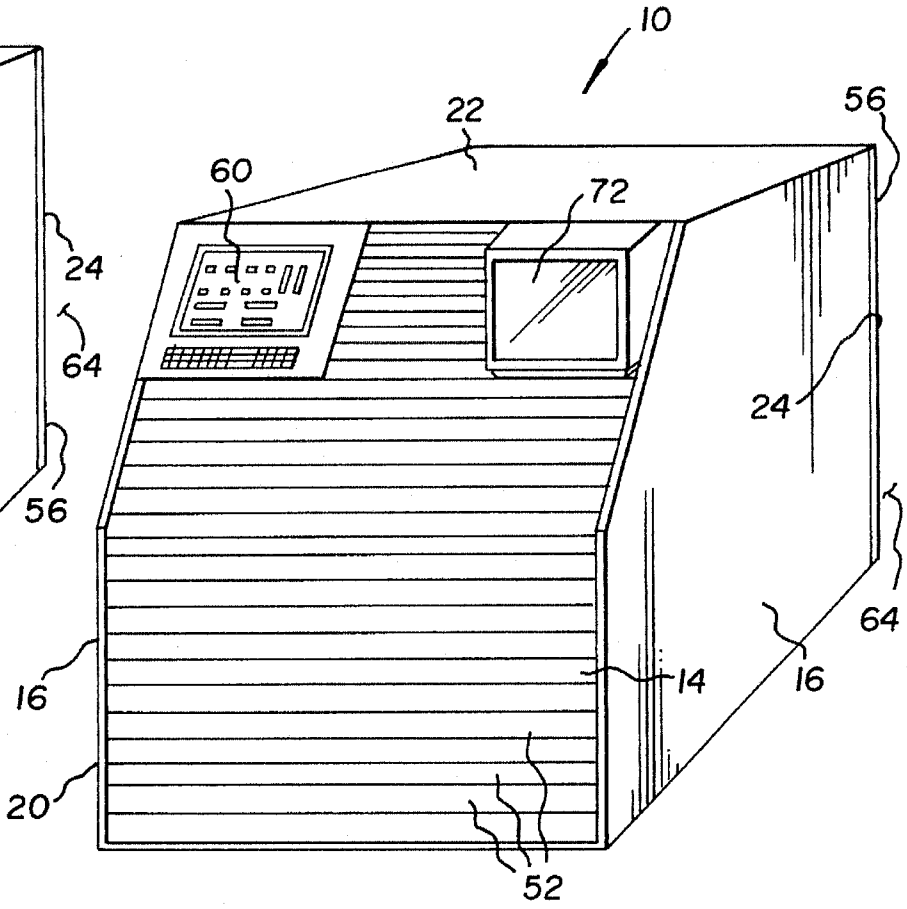
FIG. 4 is a view as in FIG. 3, but with the entry door in the closed position.
Figure 3:
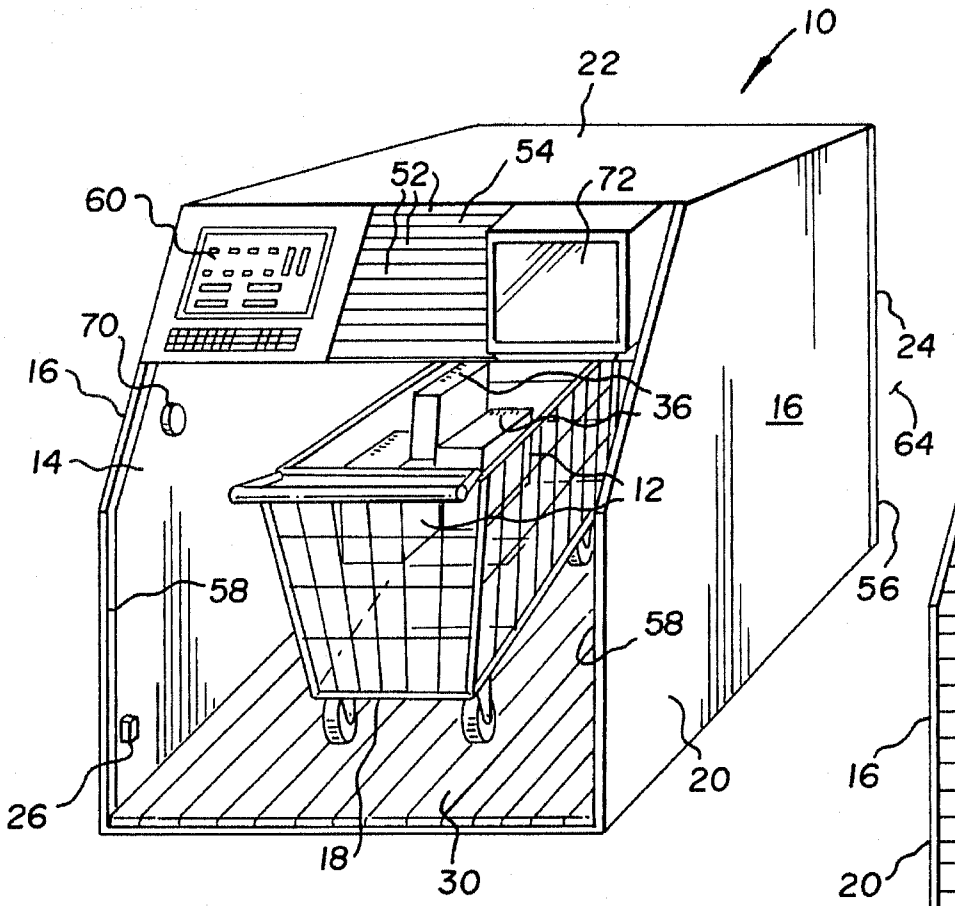
FIG. 3 is a view as in FIG. 2 but with the entry door added in the open position and a monitor display added.
Figure 5:
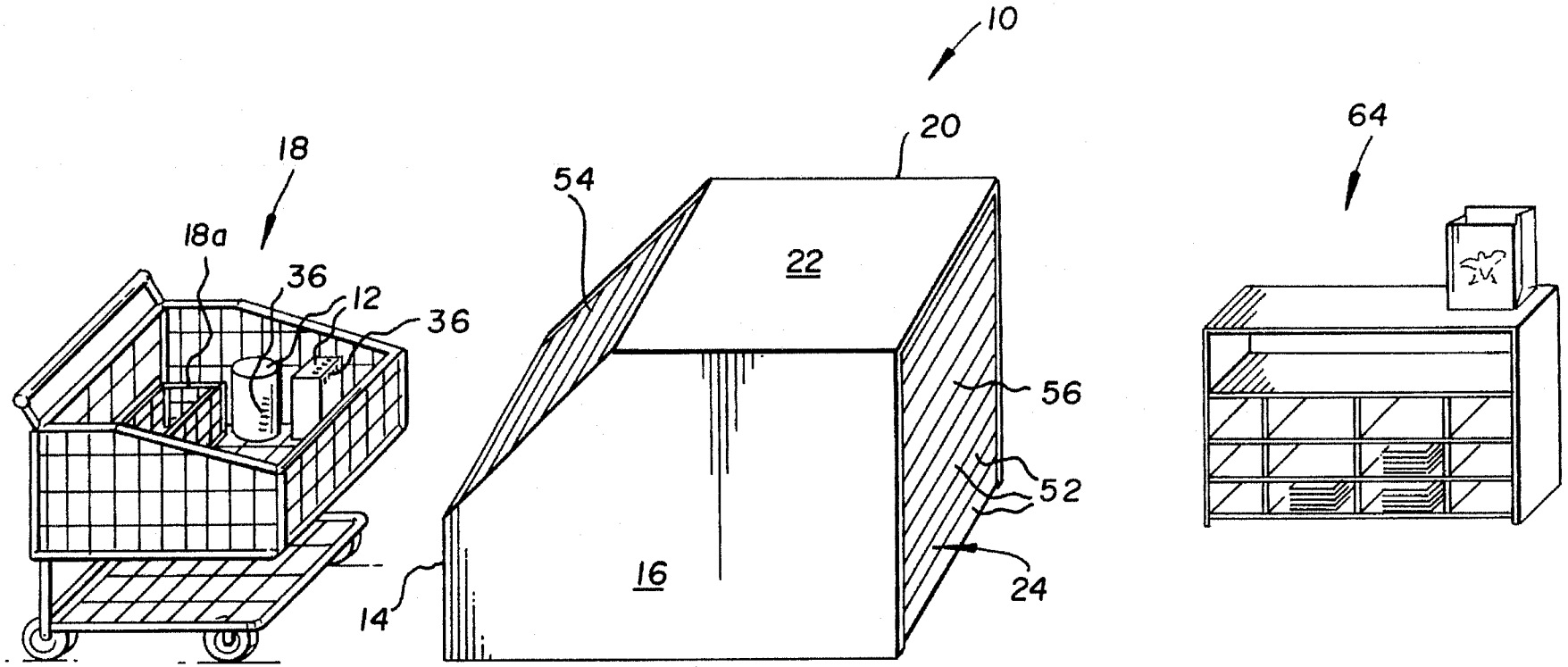
FIG. 5 is a side perspective view of the inventive apparatus, revealing the exit port and bagging area.

Referring to FIGS. 1–5, an automated checkout apparatus 10 is disclosed for use in stores selling purchase items 12. Each customer gathers and carries items 12 to a checkout area in an item holder 18, such as a basket or shopping cart. Apparatus 10 rapidly and virtually simultaneously reads and totals prices of items 12 selected for purchase while items 12 remain inside the item holder 18. A shopping cart preferably contains several item 12 receiving baskets **18*a*, in which the customer transports items 12 from the store after checkout and payment. These baskets 18*a*** may be disposable or may be loaned to customers upon payment of a deposit and returned when they next visit the store.

Apparatus 10 preferably includes an item holder receiving tunnel 20 having an entry port 14, opposing side walls 16, a top wall 22, and an exit port 24. Tunnel 20 has a floor covered by a conveyor belt 30 for supporting and carrying the item holder 18 from entry port 14 to exit port 24. A holder sensor 26 adjacent entry port 14 and connected to a computer 28 detects the presence of a holder 18 placed at entry port 14. Computer 28 then activates conveyor belt 30 for a sufficient time duration to carry the holder 18 inside tunnel 20, and then stops conveyor belt 30. A scale (not shown) weighs holder 18 and its contents and relays this data to computer 28.

Each purchase item 12 is marked with a bar code 36 identifying the item 12, its price and its weight. Each item 12 may be very specifically identified, or it may be identified only by general category, such as produce or stock. A scanner assembly 40 inside tunnel 20 scans through holder 18 and reads bar codes 36 on items 12 without the need of removing the items 12 from holder 18. Computer 28 is electrically connected to scanner assembly 40 and automatically totals the weights of the items which is added to the weight of the holder 18 and compared with the scale reading. If there is not a match, this indicates that one or more item codes were not read or were incorrect. In this event computer 28 causes scanner assembly 40 to again scan bar codes 36, and possibly from a different angle. In the event one bar code 36 is directly behind another during scanning, so that their images are in effect superimposed, the images are effectively sliced into pieces and reassembled by computer 28 in a process similar to what is called tomography so that they can be read. When there is a match, the prices are read from bar codes 36 and a receipt is printed.

Tunnel 20 preferably has a motorized roll-top desk style entry door 54 and exit door 56 for opening and closing entry port 14 and exit port 24, respectively. A series of pivotally and longitudinally interconnected slat members 52 form each door 54 and 56, and doors 54 and 56 each slide in opposing tracks 58 on walls 16. Doors 54 and 56 both automatically close when the holder 18 is carried into tunnel 20 by conveyor belt 30 and provide a variety of safety and security functions. These functions include keeping children and pets out of tunnel 20 during code scanning. Doors 54 and 56 also prevent tampering with the bar codes 36 during the scanning operation and secure items 12 against theft until the customer pays for them. Doors 54 and 56 remain closed until cash, a credit card, coupons or other payment means are inserted into a payment receiving assembly 60, which is mounted above entry port 14 and electrically connected to computer 28, and the totalled price is thereby paid. Then computer 28 activates entry and exit doors 14 and 24 so that both open, and activates conveyor belt 30 to carry holder 18 to a bagging area 64. Then the customer or a store employee bags items 12 for transport from the store. A monitor screen 72 may be provided to view items 12 within tunnel 20.

An intruder sensor assembly 70 is also preferably provided inside tunnel 20 to detect any human or animal presence within tunnel 20. Upon detection, a signal is electrically relayed from assembly 70 to computer 28, which automatically prevents closure of doors 54 and 56, and prevents activation of belt 30 and bar code scanner assembly 40, until the intruder is no longer detected.

Holder 18 either has holes through which scanner assembly 40 reads bar codes 36 or holder 18 is transparent to the scanning medium used. A variety of scanning media are contemplated for scanner assembly 40. These include ultrasound waves, micro-waves, X-rays, infra-red rays, and ultra violet rays.

Ultra-sound employs ultra high frequency sound waves and forms televised or other images of objects and codes. It does not produce radiation and is harmless. With the image of items 12 reproduced, computer 28 then reads bar codes 36, even if printed in conventional bar code ink. Microwaves produced by radar can form a visible image by a number of electronic methods which convert reflected pulses into visible symbols on a display. Bar codes 36 might be printed in a special reflecting ink for this purpose. Infra-red radiation is harmless at low intensity. Longer wavelengths of infrared radiation are not absorbed by an object and dissipated as heat, but penetrate to create imagery. The imagery created can be of item bar codes 36. Ultraviolet (UV) radiation is possibly suitable for bar code reading. An electromagnetic field might be created within tunnel 20 capable of detecting and reading bar codes 36 printed with special magnetic ink. The electromagnetic field might be activated by the reading of an electronic computer chip secured to each item 12 as an alternative to the bar code 36. Today's electronic chips have a large memory capacity capable of retaining a complete description of the given item 12. The current price of these chips is about four cents in United States currency, but improvements are being made to make them even less expensive and easier to print onto items 12. The creation of an electromagnetic field within tunnel 20 would activate and read the memories of the chips.

Although X-rays may initially seem dangerous, today's technology has virtually eliminated possible health risks. This is achieved with minute control of the intensity, direction and absorption of the X-rays. Such safety and control is evidenced by the thousands of passengers who confidently pass their luggage and their bodies through X-ray detectors at airports every day. And there have been no complaints about this procedure. This is so even though these detectors have no heavy doors or other special shielding. Indeed, none is needed because the X-rays are of low intensity, directed through the luggage or the passenger, and then simply absorbed by the detector walls. Low intensity X-rays are known to be harmless and yet they retain more than sufficient penetrating power to accomplish their task, due to their relatively short wavelengths and their high energy.

In the present application, the bar codes 36 might be printed with radio-opaque ink to make the codes 36 visible with X-rays and thereby readable by the computer 28. The walls of the tunnel 20 would be constructed with sufficient thickness to attract and absorb the X-rays. These walls would be replaced when they have absorbed a pre-determined quantity of radiation.

Method

In practicing the invention, the following method may be used. Purchase items 12 are placed into a purchase item holder 18. Holder 18 is passed through tunnel 20. Scanner assembly 40 reads bar codes 36 on items 12 while items 12 remain in holder 18. Computer 28 totals prices indicated in bar codes 36. The customer pays the total price and the holder 18 is expelled from tunnel 20. Items 12 are removed from holder 18 and bagged for transport from the store. Additional steps may include moving the holder 18 through tunnel 20 on a conveyor belt 30 and closing doors 54 and 56 to secure items 12 and tunnel 20 during bar code 36 scanning.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An automatic bulk self-checkout apparatus, comprising:

an item holder in the form of a shopping cart comprising a cart lower wall, a cart side wall extending upwardly from said cart lower wall, a cart carriage structure secured below said cart lower wall, and a plurality of cart wheels rotatably mounted on said cart carriage structure, said item holder being for retaining purchase items in random purchase item orientations as said purchase items are gathered and transported to a checkout area of a store, a plurality of purchase items, each said item being marked with a bar code containing item price information, and randomly placed in said shopping cart, bar code scanning means for reading said bar codes while said items are randomly positioned inside said item holder and for sending information contained in said bar codes as signals, and bar code processing means for receiving and converting said signals into numerical price data and for totalling prices of said items within said item holder.

2. An apparatus according to claim 1, additionally comprising a tunnel structure having an entry port, an exit port, a top wall and two opposing side walls and a floor, and sized to receive through said ports said item holder, wherein said scanning means is located within said tunnel structure and oriented to scan said bar codes on said items within said item holder.

3. An apparatus according to claim 2, wherein said floor additionally comprises conveyor belt means for automatically transporting said item holder through said tunnel structure from said entry port to said exit port.

4. An apparatus according to claim 3, additionally comprising first sensor means for sensing an item holder placed at said entry port and activating said conveyor belt means for a prescribed time duration.

5. An apparatus according to claim 2, additionally comprising an entry door for opening and closing said entry port and an exit door for opening and closing said exit port.

6. An apparatus according to claim 5, wherein said entry door and said exit door are formed of a series of pivotally and longitudinally interconnected slat members, and wherein motor means are provided to open and close said entry and exit doors.

7. An apparatus according to claim 1, wherein said item holder contains item retaining baskets for retaining said items after checkout while said items are transported from said store.

8. An apparatus according to claim 1, wherein said bar code scanning means comprises ultra-sonic wave generating and sensing means.

9. An apparatus according to claim 1, wherein said bar code scanning means comprises ultra-violet wave generating and sensing means.

10. An apparatus according to claim 1, wherein said bar code scanning means comprises X-ray wave generating and sensing means.

11. An apparatus according to claim 1, wherein said bar code scanning means comprises magnetic field generating and sensing means.

12. An apparatus according to claim 1, wherein said bar code scanning means comprises micro-wave generating and sensing means.

13. An apparatus according to claim 1, wherein said bar code scanning means comprises infra-red wave generating and sensing means.

14. An automatic bulk self-checkout apparatus, comprising:

a plurality of purchase items, each said item being marked with a bar code containing item price information, a purchase item holder for retaining purchase items as they are gathered and transported to a checkout area of a store, bar code scanning means for reading said bar codes while said items are inside said item holder and for sending information contained in said bar codes as signals, bar code processing means for receiving and converting said signals into numerical price data and for totalling prices of said items within said item holder, a tunnel structure having an entry port, an exit port, a top wall and two opposing side walls and a floor, and sized to receive through said ports said item holder, wherein said scanning means is located within said tunnel structure and oriented to scan said bar codes on said items within said item holder, and an entry door for opening and closing said entry port and an exit door for opening and closing said exit port, wherein said entry door and said exit door are formed of a series of pivotally and longitudinally interconnected slat members, and wherein motor means are provided to open and close said entry and exit doors.

* * * * *